US011701764B2

(12) United States Patent
Kyooka et al.

(10) Patent No.: US 11,701,764 B2
(45) Date of Patent: Jul. 18, 2023

(54) SLEEVE-COMPONENT EXTRACTING JIG

(71) Applicants: KYOOKA Co., Ltd., Tokyo (JP); Noriaki Ii, Aichi (JP)

(72) Inventors: Yoshiteru Kyooka, Tokyo (JP); Yutaka Adachi, Aichi (JP); Noriaki Ii, Aichi (JP)

(73) Assignees: KYOOKA Co., Ltd., Tokyo (JP); Noriaki Ii, Aichi (JP)

( * ) Notice: Subject to any disclaimer, the term of this patent is extended or adjusted under 35 U.S.C. 154(b) by 0 days.

(21) Appl. No.: 16/310,557

(22) PCT Filed: May 31, 2018

(86) PCT No.: PCT/JP2018/020985
§ 371 (c)(1),
(2) Date: Dec. 17, 2018

(87) PCT Pub. No.: WO2019/229937
PCT Pub. Date: Dec. 5, 2019

(65) Prior Publication Data

US 2019/0366522 A1 Dec. 5, 2019

(51) Int. Cl.
*B25B 27/073* (2006.01)
*B25B 27/06* (2006.01)

(52) U.S. Cl.
CPC ..... *B25B 27/062* (2013.01); *B25B 27/06* (2013.01)

(58) Field of Classification Search
CPC ..... B23B 11/02; B23Q 3/06; B23Q 3/067; B25B 11/02; B25B 11/06; B25B 11/062;
(Continued)

(56) References Cited

U.S. PATENT DOCUMENTS 559,372 A * 5/1896 Elterich ..... B23G 5/06 408/218
1,227,391 A * 5/1917 Cooper ..... B25B 13/54 81/442
(Continued)

FOREIGN PATENT DOCUMENTS

JP 59062928 U1 * 10/1982 ..... B21H 3/027
JP 59-062928 4/1984
(Continued)

OTHER PUBLICATIONS

Official Communication issued in International Bureau of WIPO Patent Application No. PCT/JP2018/020985, dated Jul. 10, 2018.
(Continued)

*Primary Examiner* — Tyrone V Hall, Jr.
(74) *Attorney, Agent, or Firm* — Greenblum & Bernstein, P.L.C.

(57) ABSTRACT

A sleeve-component extracting jig according to the present invention is configured to include an engagement part on which a thread engageable with an inner circumferential surface of a sleeve component is formed, wherein a taper surface configured by cutting off crests of the thread to lower a height of the thread toward a leading end of the engagement part, and a plurality of clearance grooves open at the leading end of the engagement part and arranged at equal angular intervals in a circumferential direction of the engagement part are formed in the engagement part, a length of a radius of the engagement part at an end position of the taper surface is a sum of a length obtained by multiplying a thickness of the sleeve component by a digging ratio (20%~60%) and a length of an inside radius of the inner circumferential surface of the sleeve component.

8 Claims, 5 Drawing Sheets

(58) Field of Classification Search
CPC ... B25B 27/0028; B25B 27/02; B25B 27/023; B25B 27/06; B25B 27/062; Y10T 29/53878; Y10T 29/53883; Y10T 29/53957; Y10T 29/53848; Y10T 29/53952; Y10T 29/53657
USPC ..... 29/263, 281; 411/311, 386, 387.4, 417, 411/418
See application file for complete search history.

(56) References Cited

U.S. PATENT DOCUMENTS

| | | | | | |
|---|---|---|---|---|---|
| 1,286,897 | A * | 12/1918 | Albertson | B25B 27/06 | 29/281 |
| 1,338,495 | A * | 4/1920 | Donelson | B25B 27/02 | 29/281 |
| 1,381,101 | A * | 6/1921 | Albertson | B25B 27/06 | 29/263 |
| 2,305,076 | A * | 12/1942 | Graham | B25B 27/062 | 29/263 |
| RE28,907 | E * | 7/1976 | Eibes | B21H 3/027 | 411/417 |
| 5,033,919 | A * | 7/1991 | Choe | B23G 5/062 | 408/217 |
| 6,929,024 | B1 * | 8/2005 | Rucker | B25B 27/062 | 137/315.41 |
| 7,665,934 | B2 | 2/2010 | Henderer et al. | | |
| 2004/0170482 | A1 * | 9/2004 | Henderer | B23G 5/06 | 408/222 |
| 2008/0075550 | A1 | 3/2008 | Reed | | |
| 2008/0095587 | A1 | 4/2008 | Henderer et al. | | |
| 2009/0313799 | A1 | 12/2009 | Oguri | | |
| 2010/0095500 | A1 | 4/2010 | Whitaker | | |
| 2010/0329803 | A1 * | 12/2010 | Strom | B23G 5/062 | 408/1 R |
| 2014/0105697 | A1 * | 4/2014 | Osawa | B23G 7/02 | 408/57 |

FOREIGN PATENT DOCUMENTS

| | | |
|---|---|---|
| JP | 63-232983 | 9/1988 |
| JP | 3016627 | 10/1995 |
| JP | 2010-000552 | 1/2010 |
| JP | 2010-506747 | 3/2010 |
| JP | 2010-264582 | 11/2010 |
| JP | 2011-36926 | 2/2011 |
| JP | 5452976 | 3/2014 |
| WO | 2008/048853 | 4/2008 |

OTHER PUBLICATIONS

Office Action (Decision to Grant a Patent) in counterpart Japan Patent Application No. 2018-567758, dated Nov. 5, 2019 (with Complete English translation).
Complete English translation of Office Action in counterpart Japan Patent Application No. 2018-567758, dated Jul. 9, 2019.
Official Action in counterpart Japanese Patent Application No. 2018-567758, dated Jul. 9, 2019 (with English translation).
Chinese Office Action, Chinese Patent Office, Application No. 201880002493.9, dated Jul. 3, 2020, with English translation.

* cited by examiner

SLEEVE-COMPONENT EXTRACTING JIG

TECHNICAL FIELD

The present invention relates to a sleeve-component extracting jig for extracting a sleeve component that is press-fitted into a panel made of fiber-reinforced plastic.

BACKGROUND ART

Patent Literature 1 discloses a sleeve-component extracting device for extracting a metallic sleeve component that is press-fitted into an insertion hole provided on a panel made of carbon fiber reinforced plastic (hereinafter, "CFRP panel").

CITATION LIST

Patent Literature

Patent Literature 1: Japanese Patent No. 5452976

SUMMARY OF INVENTION

Technical Problem

In an example disclosed in Patent Literature 1, a flat part is provided at the leading end of a thread provided on a sleeve engagement part in the sleeve-component extracting device to prevent the thread from excessively digging into an internal circumferential surface of the sleeve component. However, there is a problem that the internal wall of the insertion hole provided on the CFRP panel is damaged via the sleeve component due to pressing of the flat part against the internal circumferential surface of the sleeve component.

If the internal wall of the insertion hole is damaged by an operation of extracting the sleeve component from the CFRP panel, the insertion hole needs to be increased in the diameter to remove the damages. As a result, the number of times of recycle of the CFRP panel is decreased, which leads to increase in the maintenance cost of a device (such as an airplane or an automobile) to which the CFRP panel is attached.

The present invention has been made in view of the problem described above. It is an object of the present invention to provide a sleeve-component extracting jig that enables reliable extraction of a sleeve component from a panel made of fiber-reinforced plastic (hereinafter, "FRP panel") while suppressing damages on the internal wall of an insertion hole provided on the FRP panel.

Solution to Problem

In order to solve the above problem, a sleeve-component extracting jig according to an aspect of the present invention is configured to include an engagement part on which a thread engageable with an inner circumferential surface of a sleeve component is formed, wherein a taper surface configured by cutting off crests of the thread to lower a height of the thread toward a leading end of the engagement part, and a plurality of clearance grooves open at the leading end of the engagement part and arranged at equal angular intervals in a circumferential direction of the engagement part are formed in the engagement part, a length of a radius of the engagement part at an end position of the taper surface is a sum of a length obtained by multiplying a thickness of the sleeve component by a digging ratio and a length of an inside radius of the inner circumferential surface of the sleeve component, and the digging ratio has a value in a range between 20% and 60%.

Advantageous Effects of Invention

According to the present invention, it is possible to reliably extract a sleeve component from an FRP panel while suppressing damages on the internal wall of an insertion hole provided on the FRP panel at the time of insertion of a sleeve-component extracting jig into the sleeve component that is press-fitted into the FRP panel.

DESCRIPTION OF EMBODIMENTS

An embodiment of the present invention will be described below with reference to the drawings.

In the descriptions of the drawings explained below, like or similar reference signs are denoted to like or similar parts. Note that the drawings are schematic or conceptual, and the ratios and the like of respective dimensions are different from those of actual products. Therefore, dimensions and the like of actual products should be determined in consideration of the following descriptions. In addition, it is needless to mention that among the drawings, elements that the relations and ratios between their mutual dimensions are different are also included.

(1. Configuration of Sleeve-Component Extracting Jig)

A configuration of a sleeve-component extracting jig 10 (hereinafter, "jig 10") according to the present embodiment is described first.

Figure 1:
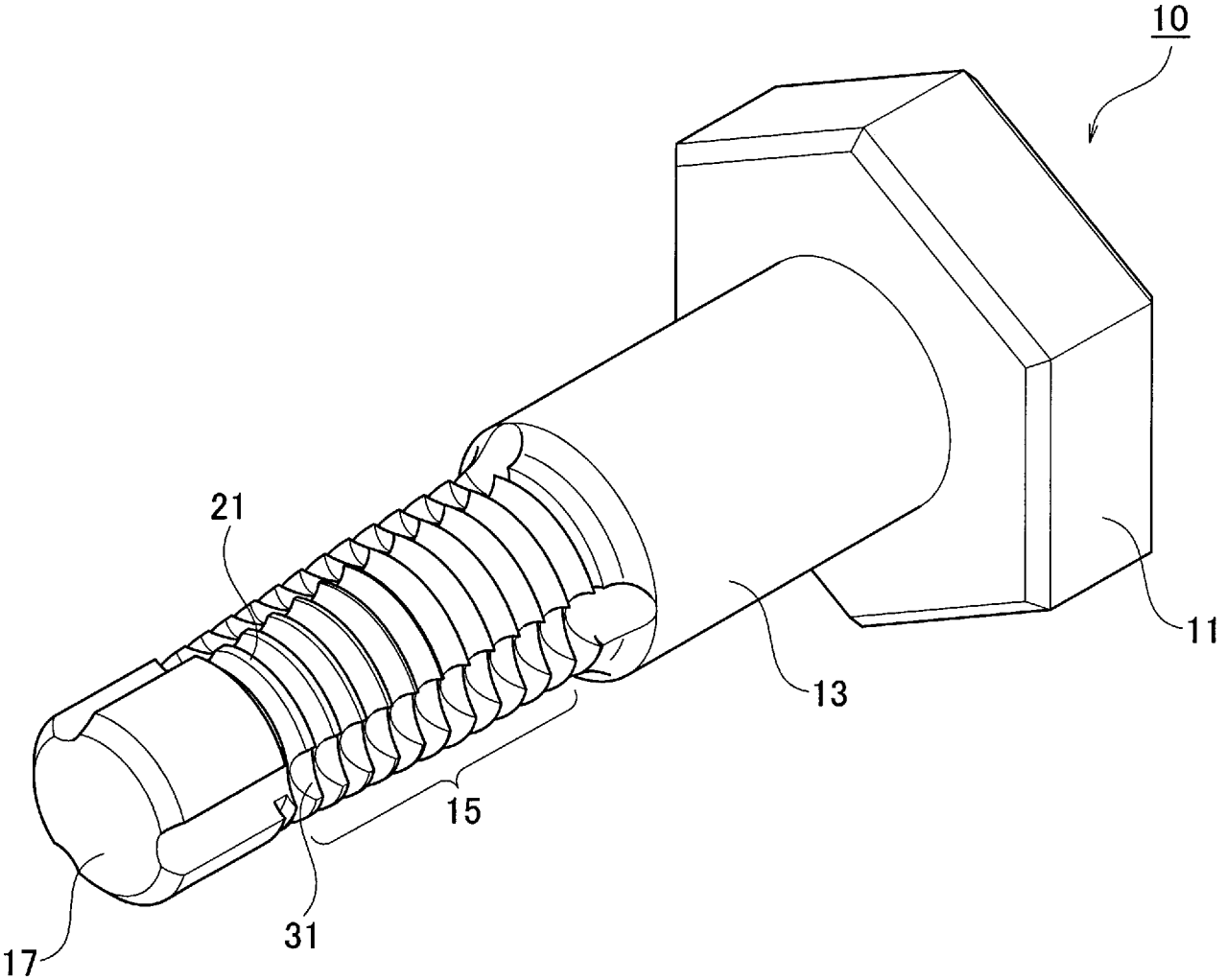
FIG. 1 is a perspective view of a sleeve-component extracting jig according to an embodiment of the present invention.
Figure 2:
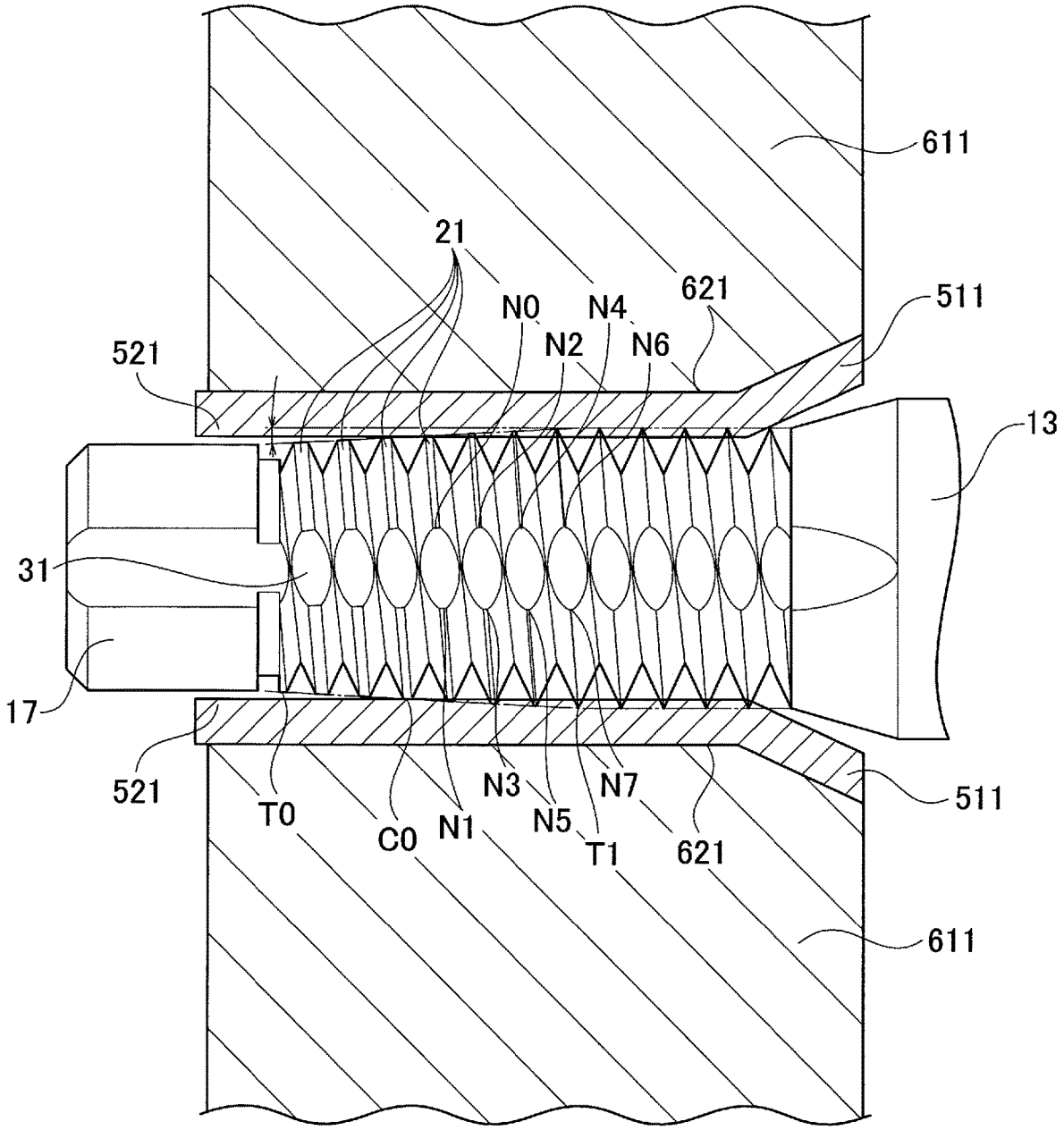
FIG. 2 is a side view illustrating a manner of engagement of the sleeve-component extracting jig according to the embodiment of the present invention with a sleeve component.
Figure 3A:
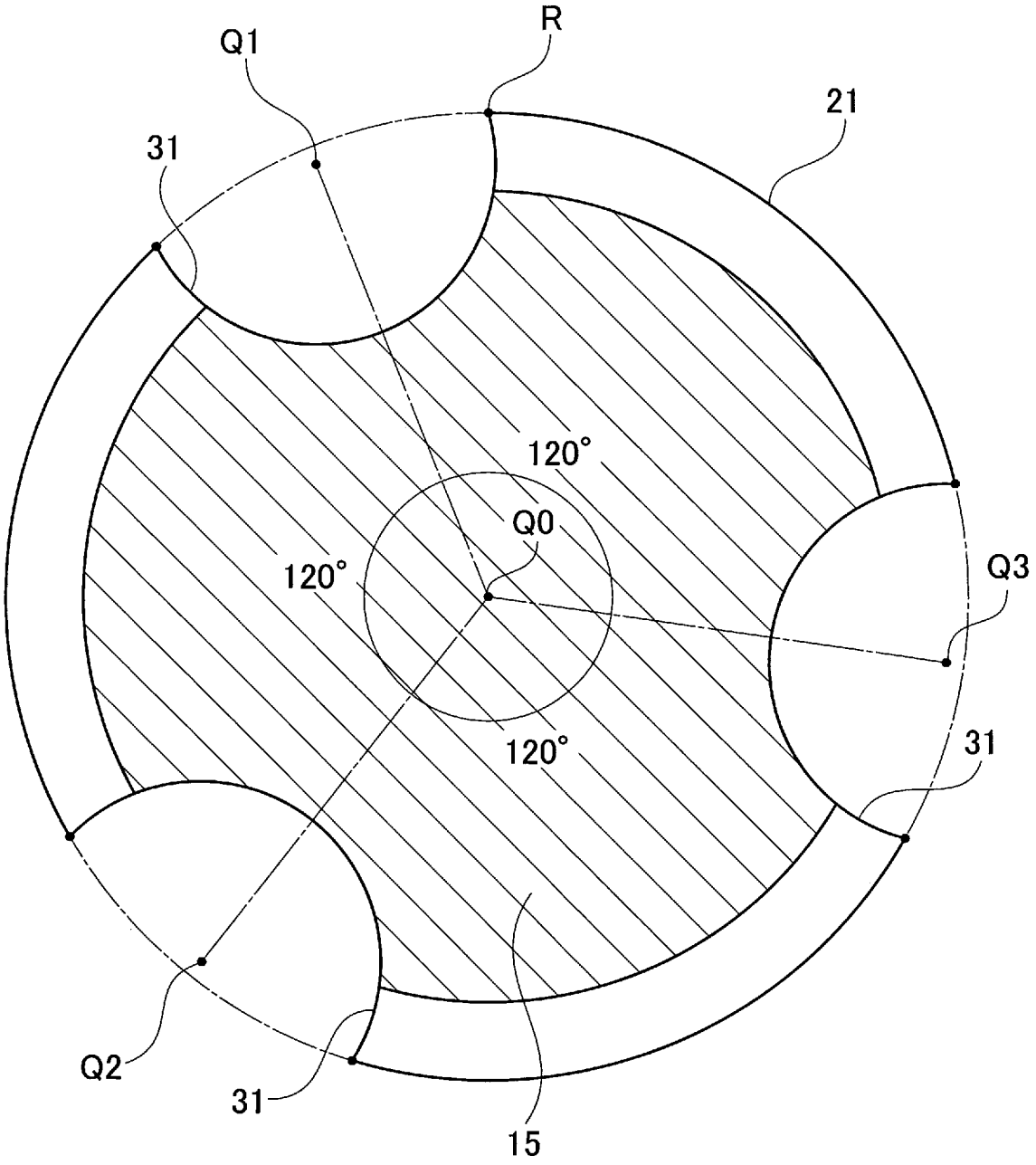
FIG. 3A is a sectional view of a sleeve engagement part included in the sleeve-component extracting jig according to the embodiment of the present invention.
Figure 3B:
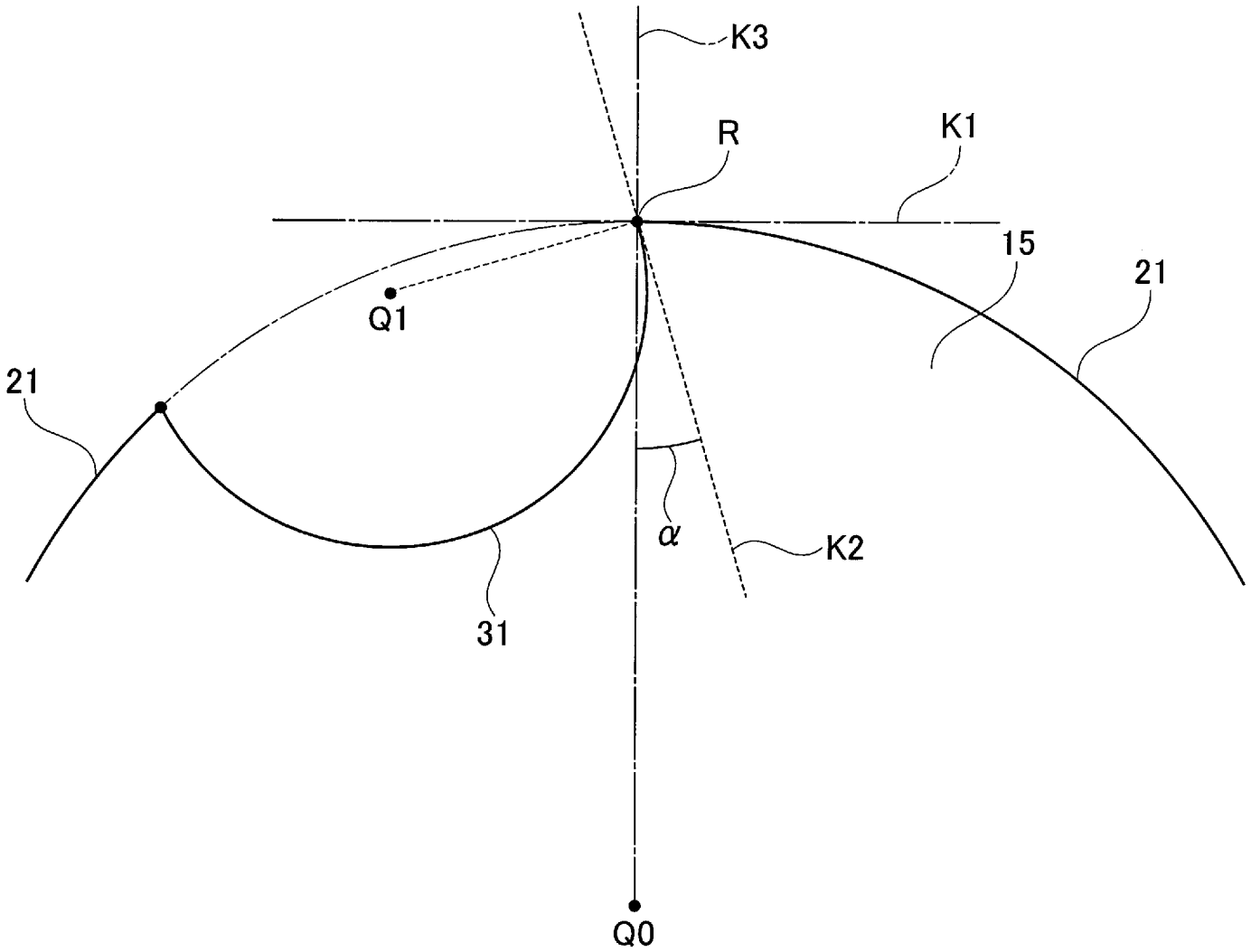
FIG. 3B is an enlarged view of cutting edges formed on a thread by clearance grooves in FIG. 3A.

FIG. 1 is a perspective view of the jig 10. FIG. 2 is a side view illustrating a manner of engagement of the jig 10 with a sleeve component 511. FIG. 3A is a sectional view of an engagement part 15 included in the jig 10 along a plane perpendicular to the central axis of the engagement part 15. FIG. 3B is an enlarged view of cutting edges formed on a thread by clearance grooves 31 in FIG. 3A.

As illustrated in FIG. 1, the jig 10 includes the engagement part 15 having a helical thread formed on an outer circumferential surface of a shaft body with a constant diameter. A cylindrical guide part 17 is formed at the leading end of the engagement part 15 integrally therewith. A cylindrical shaft part 13 is formed at the trailing end of the engagement part 15 integrally therewith. A wrench operation part 11 is further formed at the trailing end of the shaft part 13 integrally therewith. The shape of the shaft part 13 is not limited to the cylindrical shape and can be a polygonal columnar shape. Furthermore, there are different variations in the shaft part 13 according to the types of extracting devices that use the jig 10. There are also different variations in the shape of the wrench operation part 11.

The outer circumferential shape of a leading end area of the shaft part 13 connecting to the engagement part 15 can be a shape along an inner circumferential surface of the sleeve component 511, which will be described later, near an opening so as to prevent the shaft part 13 from damaging the inner circumferential surface near the opening.

Taper surfaces 21 are formed on the engagement part 15, which are formed by cutting off crests of the thread to lower the height of the thread toward the leading end of the engagement part 15. Clearance grooves 31 that are open at the leading end of the engagement part 15 are also formed on the engagement part 15.

As illustrated in FIG. 1, the clearance grooves 31 can be formed also on the guide part 17 continuously from the engagement part 15.

As illustrated in FIG. 2, the thread is lower at a position nearer to a taper start position T0 (a position where a first taper surface 21 starts) in a range from the taper start position T0 to a taper end position T1 (a position where a last taper surface 21 ends) along starts of the thread (along a direction in which the thread extends helically). In other words, the thread gradually increases in the height from the taper start position T0 to the taper end position T1 along the starts of the thread.

No taper surfaces 21 are formed and the height of the thread is constant in a range from the taper end position T1 to the trailing end of the engagement part 15 along the starts of the thread.

The taper surfaces 21 located in the range from the taper start position T0 to the taper end position T1 along the starts of the thread, and the crests of the thread located in the range from the taper end position T1 to the trailing end of the engagement part 15 along the starts of the thread form the outer circumferential portion of the engagement part 15.

The radius of the engagement part 15 at the taper end position T1 in the outer circumferential portion of the engagement part 15 is hereinafter referred to as "the radius of the engagement part".

As an example, FIG. 3A illustrates three clearance grooves 31 located at intervals of 120 degrees in the circumferential direction. Because the clearance grooves 31 are formed on the engagement part 15, there are missing parts in the thread due to the clearance grooves 31. Particularly, a side connecting the inner circumferential surface of each of the clearance grooves 31 and the corresponding taper surface 21 to each other functions as a cutting edge. The number of clearance grooves has variations other than that illustrated in the figures depending on the inside radius of the sleeve component 511.

FIG. 3A illustrates a modification in which the inner circumferential surface of each of the clearance grooves 31 is formed of a portion of a cylindrical surface. In FIG. 3A, central axes Q1, Q2, and Q3 of cylindrical surfaces that are located at intervals of 120 degrees in the circumferential direction of the engagement part 15 and that are in a plane passing through a central axis Q0 of the engagement part 15 are illustrated. The inner circumferential surface of the clearance groove 31 located at the position of the central axis Q1 is formed of a portion of a cylindrical surface having the central axis Q1. The inner circumferential surface of the clearance groove 31 located at the position of the central axis Q2 is formed of a portion of a cylindrical surface having the central axis Q2. The inner circumferential surface of the clearance groove 31 located at the position of the central axis Q3 is formed of a portion of a cylindrical surface having the central axis Q3.

FIG. 3B is an enlarged view of a portion corresponding to the cutting edge formed on the thread by the clearance groove 31 in FIG. 3A. An angle between a perpendicular K3 to a tangent K1 of the taper surface 21 and a tangent K2 of the inner circumferential surface of the clearance groove 31 at a portion denoted by a sign R is called "rake angle $\alpha$". The reason is that a cutting surface produced by a cutting edge that cuts a sleeve-component inner circumferential surface 521 among cutting edges located on the outer circumferential surface of the engagement part 15 appears at the position of the tangent K1.

(2. Engagement with Sleeve Component)

A manner of engagement of the engagement part 15 with the sleeve component 511 is described next.

As illustrated in FIG. 2, the jig 10 according to the present embodiment is used to extract the sleeve component 511 press-fitted into an insertion hole 621 provided on a panel 611. For example, materials of the panel 611 include fiber-reinforced plastic (FRP) and carbon fiber reinforced plastic (CFRP). An example of the sleeve component 511 is a metallic component.

It is assumed that the sleeve-component inner circumferential surface 521 and the inner surface of the insertion hole 621 are substantially cylindrical surfaces.

Before the engagement part 15 is engaged with the sleeve component 511, the leading end of the jig 10, that is, the guide part 17 is inserted into the sleeve component 511 and the jig 10 is inserted to a position where the taper surfaces 21 abut on the sleeve-component inner circumferential surface 521.

After the taper surfaces 21 abut on the sleeve-component inner circumferential surface 521, the jig 10 is further inserted into the sleeve component 511 while the wrench operation part 11 is rotated about the central axis of the jig 10. Particularly, the engagement part 15 is inserted into the sleeve component 511 by the lead length of the thread per rotation on the central axis of the engagement part 15. The lead length of the thread is the product of the number of starts of the thread formed on the engagement part 15 and the length of one pitch of the thread.

At that time, the sleeve-component inner circumferential surface 521 is pressed by the thread of the engagement part 15 and the sleeve-component inner circumferential surface 521 is cut by the cutting edges formed on the thread. As a result, an engagement groove along the thread of the engagement part 15 is formed on the sleeve-component inner circumferential surface 521. The formed engagement groove and the thread of the engagement part 15 then engage with each other. By pulling the jig 10 along the central axis in a direction of withdrawing from the panel 611 without rotating the jig 10 after the engagement groove of a certain length or longer is formed, it is possible to extract the sleeve component 511 engaged with the engagement part 15 from the insertion hole 621.

In order to reliably extract the sleeve component 511 with the jig 10, it is desirable that the digging ratio has a value in a range between 20% and 60% (more preferably, the digging ratio has a value in a range between 30% and 50%) where the digging ratio is a ratio of the depth of engagement of the thread formed on the engagement part 15 to the thickness of the sleeve component 511. This sufficiently ensures a state where the thread of the engagement part 15 is engaged with the formed engagement groove and enables the sleeve component 511 to be reliably extracted with the jig 10.

Furthermore, it is possible to prevent the sleeve component 511 from breaking in the middle during extraction of the sleeve component 511 from the insertion hole 621.

If the digging ratio is smaller than 20%, there is a risk that the thread on the engagement part 15 engaged with the formed engagement groove disengages from the engagement groove and the sleeve component 511 cannot be extracted. In this case, the operation needs to be performed again from the insertion of the engagement part 15 into the sleeve-component inner circumferential surface 521, which may consequently lead to damages of the inner wall of the insertion hole 621.

If the digging ratio is larger than 60%, there is a risk that the formed engagement groove becomes too deep and the sleeve component 511 breaks in the middle during extraction of the sleeve component 511 from the insertion hole 621. This may consequently lead to damages of the inner wall of the insertion hole 621.

Therefore, the length of the radius of the engagement part 15 (the length of the radius of the engagement part 15 at the taper end position T1) is determined on the basis of the length of the inside radius of the sleeve-component inner circumferential surface 521 and the thickness of the sleeve component 511. Specifically, the length of the radius of the engagement part 15 is set to the sum of a length obtained by multiplying the thickness of the sleeve component 511 by the digging ratio having a value in the range between 20% and 60% and the length of the inside radius of the sleeve-component inner circumferential surface 521.

The thickness of the sleeve component 511 may vary due to tolerance. Accordingly, the thickness of the sleeve component 511 used to determine the radius of the engagement part 15 is desirably the design thickness of the sleeve component 511. Because the radius of the engagement part 15 is determined on the basis of the design thickness of the sleeve component 511, the radius of the engagement part 15 can be determined to enable the digging ratio to fall within the predetermined range without measuring the thickness of the sleeve component 511 to be extracted, and the sleeve component 511 can be reliably extracted with the jig 10.

Furthermore, assuming that the length of an outer circumferential portion of the thread per pitch, measured along the starts of the thread in a case where the clearance grooves 31 are not provided, is L1 and the length of an outer circumferential portion of the thread per pitch, measured along the starts of the thread in a case where the clearance grooves 31 are provided, is L2, the ratio L2/L1 can be equal to or larger than 0.5 entirely on the engagement part 15. This ensures a sufficient length of the thread on the engagement part 15 engaged with the formed engagement groove and the sleeve component 511 can be reliably extracted with the jig 10.

If the ratio L2/L1 is smaller than 0.5, there is a risk that the thread on the engagement part 15 engaged with the formed engagement groove disengages from the engagement groove and the sleeve component 511 cannot be extracted. In this case, the operation needs to be performed again from the insertion of the engagement part 15 into the sleeve-component inner circumferential surface 521, which may consequently lead to damages of the inner wall of the insertion hole 621.

It is also to be noted that the thickness of the sleeve component 511 to be extracted with the jig 10 according to the present embodiment is smaller than the radius of the engagement part 15.

For example, the thickness of a sleeve component used for a main wing of an airplane is typically about 0.1 to 0.3 millimeters (about 0.01 inches) and is quite small. Meanwhile, the radius of an engagement part included in a jig used for extraction of this sleeve component is similar to the radius of an insertion hole of the sleeve component. Specifically, the radius of the engagement part is smaller than the length of the radius of the insertion hole having the sleeve component inserted thereinto and is larger than a value obtained by subtracting the length of the thickness of the sleeve component from the length of the radius of the insertion hole of the sleeve component.

Because the taper surfaces 21 are formed on the engagement part 15, the radius of the engagement part 15 at the leading end is smaller than the inside radius of the sleeve-component inner circumferential surface 521.

(3. Cutting with Cutting Edges)

Cutting with the cutting edges of the sleeve-component inner circumferential surface 521, occurring when the engagement part 15 engages with the sleeve component 511, is described next.

A state where the jig 10 is inserted to a certain depth in the sleeve component 511 as illustrated in FIG. 2 is assumed.

In FIG. 2, a state where a portion of the thread formed on the engagement part 15 in a range from an engagement start position C0 (a position where contact between the engagement part 15 and the sleeve component 511 starts) to the taper end position T1 along the starts of the thread engages with the sleeve-component inner circumferential surface 521 is illustrated.

The thickness of the sleeve component 511 may vary due to tolerance of the sleeve component 511. Therefore, the engagement start position C0 may change depending on the inside radius of the sleeve-component inner circumferential surface 521. The engagement start position C0 is located at a position nearer to the taper start position T0 as the inside radius of the sleeve-component inner circumferential surface 521 is smaller, and the engagement start position C0 is located at a position more distant from the taper start position T0 and nearer to the taper end position T1 as the inside radius of the sleeve-component inner circumferential surface 521 is larger.

However, if variations of the thickness of the sleeve component 511 are not considered, the radius of the engagement part 15 is determined on the basis of the radius of the insertion hole 621 into which the sleeve component 511 to be extracted is inserted and the thickness of the sleeve component 511, and therefore the engagement start position C0 is at a substantially fixed position.

The thread located in a range from the taper start position T0 to the engagement start position C0 along the starts of the thread does not abut on the sleeve-component inner circumferential surface 521 in the process of insertion with the jig 10.

Meanwhile, the thread located in a range from the engagement start position C0 to the taper end position T1 along the starts of the thread is higher than the thread located in the range from the taper start position T0 to the engagement start position C0 and thus abuts on the sleeve-component inner circumferential surface 521 in the process of insertion with the jig 10.

In the process of insertion of the engagement part 15 into the sleeve component 511, the cutting edges located in the range from the engagement start position C0 to the taper end position T1 along the engagement groove formed on the sleeve-component inner circumferential surface 521 move toward the leading end of the engagement groove (in a direction where the taper start position T0 is located). As a result, the bottom surface of the engagement groove is cut by the cutting edges and the engagement groove becomes deeper.

Focusing on a specific position on the engagement groove, the height of the cutting edges passing the specific position gradually increases as the insertion of the engagement part 15 into the sleeve component 511 progresses. Therefore, each time the cutting edge has passed, the engagement groove becomes deeper.

It is to be noted that there are two kinds of cutting edges in the range from the engagement start position C0 to the taper end position T1, that is, those that contribute to cutting and those that do not contribute to cutting.

For example, cutting edges formed on the thread by the clearance grooves 31 are illustrated at places denoted by signs N0 to N7 in FIG. 2. Among these cutting edges, the cutting edges at the places denoted by signs N1, N3, N5, and N7 perform cutting while the cutting edges at the places denoted by signs N0, N2, N4, and N6 do not perform cutting.

Because the clearance groove 31 is provided in front of the cutting edges at the places denoted by signs N1, N3, N5, and N7 in the moving direction, the bottom portion of the engagement groove protrudes in front of the cutting edges in the moving direction as viewed from the cutting edges when the engagement part 15 rotates. As a result, the cutting edges at the places denoted by signs N1, N3, N5, and N7 can perform cutting of the bottom portion of the engagement groove located in front in the moving direction.

On the other hand, the clearance groove 31 is not provided in front of the cutting edges at the places denoted by signs N0, N2, N4, and N6 in the moving direction but the thread is provided instead. Accordingly, even when the engagement part 15 rotates, the bottom portion of the engagement groove does not protrude in front of the cutting edges in the moving direction as viewed from the cutting edges. As a result, the cutting edges at the places denoted by signs N0, N2, N4, and N6 do not perform cutting.

Furthermore, because the heights of the cutting edges increase in the order of those at the places denoted by signs N1, N3, N5, and N7, the engagement groove is cut more deeply in this order.

In this way, the cutting edges that have the clearance groove 31 in front of the cutting edges in the moving direction among the cutting edges located in the range from the engagement start position C0 to the taper end position T1 contribute to cutting of the sleeve-component inner circumferential surface 521. Furthermore, because a cutting edge located at a position nearer to the taper end position T1 is higher, the cutting edge forms a deeper engagement groove.

As will be described later, the amount of cutting by one cutting edge ("the cutting amount of a cutting edge") is proportional to "the length along the starts of the thread" of the clearance groove 31 located in front of the cutting edge in the moving direction.

(4. Pressing by Thread)

Pressing by the thread against the sleeve-component inner circumferential surface 521 occurring when the engagement part 15 engages with the sleeve component 511 is described next.

In FIG. 2, the thread in the range from the engagement start position C0 to the taper end position T1 along the starts of the thread in the thread formed on the engagement part 15 engages with the sleeve-component inner circumferential surface 521.

Because the thread is configured in such a manner that the crests of the thread are cut off due to the taper surfaces 21 to lower the height of the thread toward the leading end of the engagement part 15, the thread gradually increases in the height from the engagement start position C0 to the taper end position T1 along the starts of the thread.

Focusing on a specific position on the engagement groove, the height of the thread passing the specific position gradually increases as the engagement part 15 rotates and is inserted into the sleeve component 511. Therefore, as the insertion of the engagement part 15 into the sleeve component 511 progresses, the thread having a height larger than the depth of the engagement groove at the specific position presses the bottom portion of the engagement groove.

As a result, in the process of insertion of the engagement part 15 into the sleeve component 511, the taper surfaces 21 in the range from the engagement start position C0 to the taper end position T1 contribute to pressing against the sleeve-component inner circumferential surface 521.

As will be described later, the amount of pressing by one continuous taper surface 21 sandwiched between cutting edges ("the pressing amount of the thread") is proportional to "the length along the starts of the thread" of the relevant taper surface.

(5. Cutting Amount and Pressing Amount)

"The cutting amount of a cutting edge" and "the pressing amount of the thread" are examined next.

Figure 4:
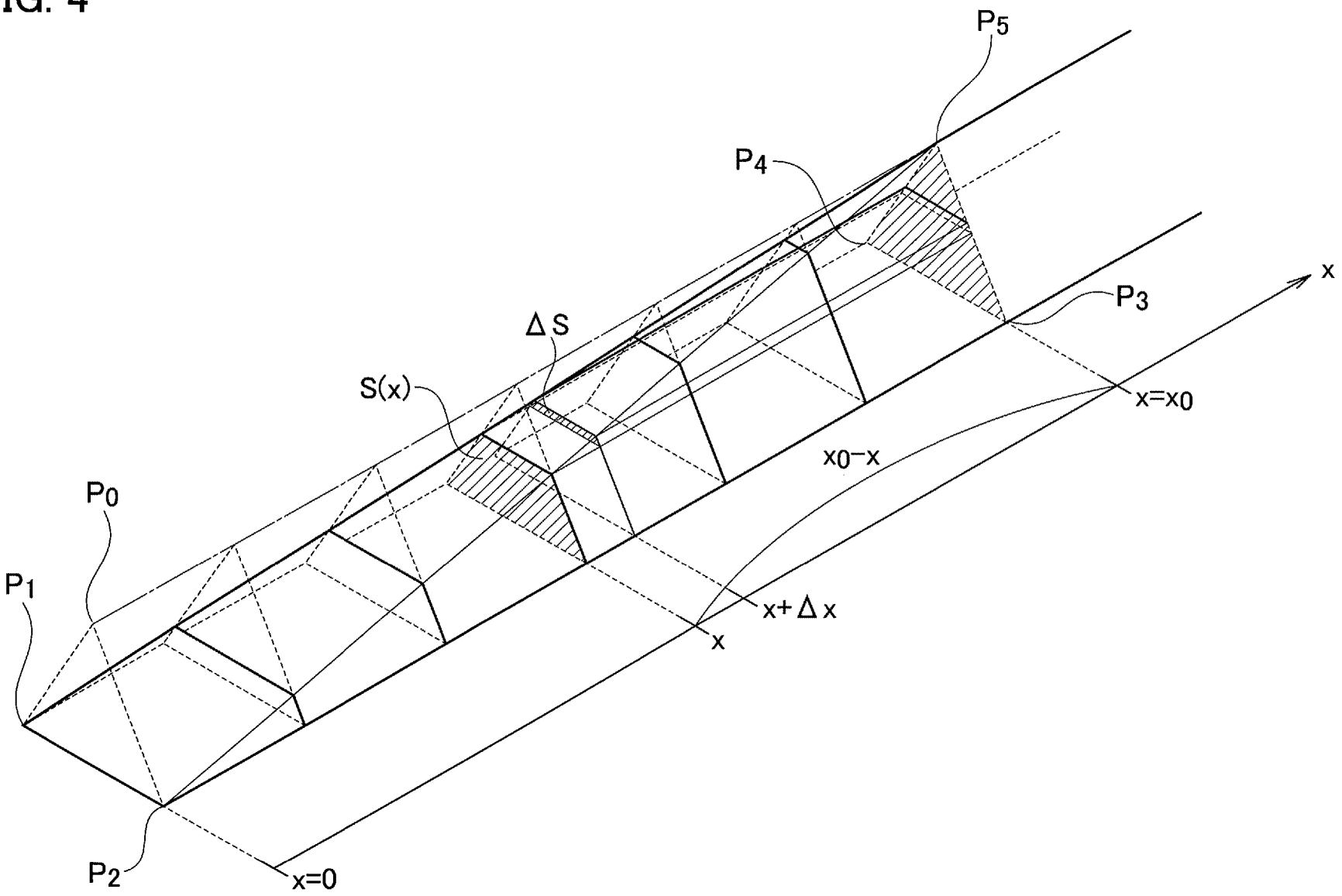
FIG. 4 is a conceptual diagram illustrating changes of a shape of the thread along starts of the thread from an engagement start position to a taper end position in a case where the clearance grooves are not provided.

FIG. 4 is a conceptual diagram illustrating changes of the shape of the thread along the starts of the thread from the engagement start position C0 (the position where contact between the engagement part 15 and the sleeve component 511 starts) to the taper end position T1 (the position where the last taper surface 21 ends) in a case where the clearance grooves 31 are not provided.

In FIG. 4, a coordinate x indicates the length of a helix from the engagement start position C0 measured along the starts of the thread (along a direction where the thread extends helically). In this example, "x=0" corresponds to the engagement start position C0 and "$x=x_0$" corresponds to the taper end position T1. For simplicity of discussions, it is hereinafter assumed that the height of the thread at the portion contributing to cutting or pressing of the sleeve-component inner circumferential surface 521 is proportional to the coordinate x.

Because a position where "x=0" is established is a position where the contact between the engagement part 15 and the sleeve component 511 starts, the shape of the thread at the portion contributing to cutting or pressing (the shape of a cross section along a plane perpendicular to the moving direction of the thread or the cutting edges) at that position is merely a line (a line "$P_1P_2$" in FIG. 4).

At a position where "$0<x<x_0$" (not including limits) is established, the shape of the thread at a portion contributing to cutting or pressing is a trapezoid (that is, a cross section of a portion obtained by removing a triangular pyramid "$P_5$-$P_0P_1P_2$" from a triangular prism "$P_0P_1P_2$-$P_3P_4P_5$" along a plane perpendicular to an x direction). As x increases (as the position starts from the engagement start position C0 to approach the taper end position T1), the height of the trapezoid increases.

Because a position where "$x=x_0$" is established corresponds to the taper end position T1, the shape of the thread at a portion contributing to cutting or pressing at that position is a triangle (a triangle "$P_3P_4P_5$" in FIG. 4). The area of the triangle "$P_3P_4P_5$" in FIG. 4 is hereinafter denoted by $S_0$.

Because the taper surfaces 21 are not provided at a position where "$x>x_0$" is established, the shape of the thread at that position is a triangle congruent to the shape of the thread at the position where "$x=x_0$" is established.

Practically, the shape of the thread at a portion contributing to cutting or pressing is not a trapezoid because the taper surfaces 21 are configured by cutting off the crests of the thread to lower the height of the thread toward the leading end of the engagement part 15. However, the length x0 is much larger than the height of the thread and therefore the shape can be approximated by a trapezoid in the following discussions.

In the following, the area of the shape of the thread at a portion contributing to cutting or pressing (the shape of a cross section along a plane perpendicular to the moving direction of the thread or the cutting edges) at a position "x" is denoted by "S(x)".

As is apparent from the above descriptions, "S(0)=0" and "$S(x_0)=S_0$" are established. The area "S(x)" can be represented by a mathematical expression of x as follows.

$$S(x) = S_0 - S_0 \cdot \{(x_0 - x)/x_0\}^2 = S_0 \cdot (-x^2 + 2x_0 \cdot x)/x_0^2. \quad (1)$$

(5-1. Cutting Amount)

In order to examine "the cutting amount of a cutting edge", a state where a cutting edge not contributing to cutting is located at a position "x" and a cutting edge contributing to cutting is located at a position "x+Δx" as a result of cutting of the thread by the clearance grooves 31 in a section from the position "x" to the position "x+Δx" is first assumed.

The sectional area "ΔS" of the engagement groove protruding in front of the cutting edge at the position "x+Δx" in the moving direction after the cutting edge at the position "x" has passed due to presence of the clearance grooves 31 can be evaluated as a value obtained by subtracting the area "S(x)" of the cutting edge at the position "x" from the area "S(x+Δx)" of the cutting edge at the position "x+Δx".

Furthermore, the cutting edge at the position "x+Δx" subsequently continues to cut the bottom portion of the engagement groove by a length "$x_0-x$". It indicates that the cutting amount "$\Delta V_1$" of the cutting edge at the position "x+Δx" is "$\Delta S\cdot(x_0-x)$". When calculated, the cutting amount "$\Delta V_1$" is represented as follows.

$$\Delta V_1 = \Delta S \cdot (x_0 - x) = (dS/dx) \cdot \Delta x \cdot (x_0 - x) = 2S_0 \Delta x \cdot (x_0 - x)^2 / x_0^2. \quad (2)$$

Approximation is used to evaluate the cutting amount "$\Delta V_1$", assuming that $\Delta x/x_0$ is a minute amount.

Correctness of the above expression (2) as evaluation of the cutting amount is justified by a fact that a value obtained by integrating the cutting amount "$\Delta V_1$" from "x=0" to "$x=x_0$" is equal to the volume "$2S_0x_0/3$" of the portion obtained by removing the triangular pyramid "$P_5$-$P_0P_1P_2$" from the triangular prism "$P_0P_1P_2$-$P_3P_4P_5$".

As indicated by the above expression (2), it is found that "the cutting amount of a cutting edge" is proportional to Δx. Because the coordinate x is the length of the helix from the engagement start position C0, which is measured along the starts of the thread, it can be said that Δx is "the length along the starts of the thread" of the clearance groove 31 located in front of the cutting edge in the moving direction.

Therefore, "the cutting amount of a cutting edge" is proportional to "the length along the starts of the thread" of the clearance groove 31 located in front of the relevant cutting edge in the moving direction.

Furthermore, as indicated by the expression (2), "the cutting amount of a cutting edge" is proportional to the area $S_0$ of the shape of the thread at the portion contributing to cutting or pressing. It is found that "the cutting amount of a cutting edge" is larger as the relevant cutting edge is nearer to the engagement start position C0 along the starts of the thread. That is, "the cutting amount of a cutting edge" is likely to be larger toward the leading end of the engagement part 15.

(5.2 Pressing Amount)

In order to examine "the pressing amount of the thread", a state where a cutting edge contributing to cutting is located at a position "x" and a cutting edge not contributing to cutting is located at a position "x+Δx" as a result of cutting of the thread by the clearance grooves 31 and there are not any other cutting edges between these two cutting edges is assumed. That is, a state where one continuous taper surface 21 sandwiched between the cutting edges is located in a section from the position "x" to the position "x+Δx" is assumed.

The sectional area "ΔS" of a portion pressed by one continuous taper surface 21 sandwiched between the cutting edges can be evaluated as a sectional area "ΔS" obtained by subtracting the area "S(x)" of the cutting edge at the position "x" from the area "S(x+Δx)" of the cutting edge at the position "x+Δx".

Furthermore, because the length of the pressed portion is "$x_0-x$", it is found that a pressing amount "$\Delta V_2$" is "$\Delta S\cdot(x_0-x)$". Therefore, when calculated, the pressing amount "$\Delta V_2$" is represented as follows.

$$\Delta V_2 = 2S_0 \Delta x \cdot (x_0 - x)^2 / x_0^2 \quad (3).$$

Approximation is used to evaluate the pressing amount "$\Delta V_2$", assuming that $\Delta x/x_0$ is a minute amount.

Correctness of the above expression (3) as evaluation of the pressing amount is confirmed in an identical manner to the correctness of the expression (2) as evaluation of the cutting amount.

As indicated by the above expression (3), it is found that "the pressing amount of the thread" is proportional to Δx. Because the coordinate x is the length of the helix from the engagement start position C0, which is measured along the starts of the thread, it can be said that Δx is "the length along the starts of the thread" of one continuous taper surface 21 sandwiched between cutting edges.

Therefore, "the pressing amount of the thread" is proportional to "the length along the starts of the thread" of one continuous taper surface 21 sandwiched between cutting edges.

Furthermore, as indicated by the expression (3), "the pressing amount of the thread" is proportional to the area $S_0$ of the shape of the thread at the portion contributing to cutting or pressing. It is also found that "the pressing amount of the thread" is larger as the relevant cutting edge is nearer to the engagement start position C0 along the starts of the thread. That is, "the pressing amount of the thread" is likely to be larger toward the leading end of the engagement part 15.

(6. Characteristics Described in the Present Embodiment)

Characteristics and effects of the present invention described in the present embodiment are explained below.

(6-1. Characteristics and Effects of Groove Width of Clearance Grooves)

In the sleeve-component extracting jig according to the present embodiment, the engagement part 15 has a helical thread formed on the outer circumferential surface of the shaft body with a constant diameter, where the thread is engageable with the sleeve-component inner circumferential surface 521 of the sleeve component 511. The taper surfaces 21 configured by cutting off the crests of the thread to lower the height of the thread toward the leading end of the engagement part 15, and a plurality of the clearance grooves 31 open at the leading end of the engagement part 15 and placed at equal angular intervals in the circumferential direction of the engagement part 15 are formed on the engagement part 15. The length of the radius of the engagement part 15 at the taper end position T1 of the taper surfaces 21 is set to the sum of the length obtained by multiplying the thickness of the sleeve component 511 by a digging ratio having a value in the range between 20% and 60% and the length of the inside radius of the sleeve-component inner circumferential surface 521.

Accordingly, a state where the thread on the engagement part 15 engages with the formed engagement groove can be sufficiently ensured and the sleeve component 511 can be reliably extracted with the jig 10. Furthermore, it is possible to prevent the sleeve component 511 from breaking in the middle during extraction of the sleeve component 511 from the insertion hole 621.

In the sleeve-component extracting jig according to the present embodiment, when the length of the outer circumferential portion of the thread per pitch, measured along the starts of the thread in a case where the clearance grooves 31 are not provided is L1 and the length of the outer circumferential portion of the thread per pitch, measured along the starts of the thread in a case where the clearance grooves 31 are provided is L2, the ratio L2/L1 can be equal to or larger than 0.5 entirely on the engagement part 15. Accordingly, a sufficient length of the thread on the engagement part 15 engaged with the formed engagement groove can be ensured and the sleeve component 511 can be reliably extracted with the jig 10.

It has been already described that the engagement groove is formed on the sleeve-component inner circumferential surface 521 when the engagement part 15 engages with the sleeve component 511 in the sleeve-component extracting jig according to the present embodiment. Reducing "the pressing amount of the thread" described above during formation of the engagement groove results in prevention of damages on the inner wall of the insertion hole 621 provided in the panel 611. At the same time, increasing "the cutting amount of a cutting edge" described above results in reliable formation of the engagement groove and results in more reliable engagement of the engagement part 15 with the sleeve component 511.

Therefore, in the sleeve-component extracting jig according to the present embodiment, the clearance grooves 31 can be formed to decrease the ratio of the total length of the groove widths of the clearance grooves 31, which are measured along the circumferential direction, to the length of the outer circumferential portion of the engagement part 15, which is measured along the circumferential direction, toward the leading end of the engagement part 15 (as the position is nearer to the leading end). The clearance grooves 31 formed in this way reduce "the pressing amount of the thread" relative to "the cutting amount of a cutting edge" toward the leading end of the engagement part 15.

More specifically, when the length of the outer circumferential portion of the thread per pitch, which is measured along the starts of the thread in a case where the clearance grooves 31 are not provided is L1 and the length of the outer circumferential portion of the thread per pitch, which is measured along the starts of the thread in a case where the clearance grooves 31 are provided is L2, the ratio L2/L1 is set to be smaller toward the leading end of the engagement part 15 for the thread located between the leading end of the engagement part 15 and the end position of the taper surfaces 21. As a result, "the pressing amount of the thread" is smaller than "the cutting amount of a cutting edge" toward the leading end of the engagement part 15.

Therefore, because "the pressing amount of the thread" is smaller than "the cutting amount of a cutting edge" toward the leading end of the engagement part 15, the engagement groove is formed reliably and the engagement part 15 can engage with the sleeve component 511 more reliably while damages on the inner wall of the insertion hole 621 provided on the panel 611 are prevented.

"The pressing amount of the thread" is larger than "the cutting amount of a cutting edge" toward the trailing end of the engagement part 15. However, as indicated by the expression (2) and the expression (3) described above, the absolute amounts of "the cutting amount of a cutting edge" and "the pressing amount of the thread" are smaller toward the trailing end of the engagement part 15. Therefore, also in an area near the trailing end of the engagement part 15, damages on the inner wall of the insertion hole 621 provided on the panel 611 are suppressed.

(6-2. Characteristics and Effects of Arrangement of Clearance Grooves)

In the sleeve-component extracting jig according to the present embodiment, a plurality of the clearance grooves 31 arranged at equal angular intervals in the circumferential direction of the engagement part 15 can be formed. In this case, arrangement of the clearance grooves 31 at equal angular intervals enables the cutting edges to be arranged at equal angular intervals in the circumferential direction of the engagement part 15. Therefore, cutting by the cutting edges is performed uniformly along the circumferential direction of the engagement part 15 and also the depth of the engagement groove formed on the sleeve-component inner circumferential surface 521 approaches a uniform depth.

Therefore, engagement between the engagement part 15 and the sleeve component 511 approaches uniform engagement along the circumferential direction and the engagement part 15 becomes easier to engage with the sleeve component 511 while the position misalignment between the central axis of the engagement part 15 and the central axis of the sleeve-component inner circumferential surface 521 is suppressed. Accordingly, at the time of insertion of the jig 10 into the sleeve component 511, engagement where the central axis of the engagement part 15 is located diagonally to the central axis of the sleeve component 511 is suppressed and thus damages on the inner wall of the insertion hole 621 provided on the panel 611 can be suppressed.

Furthermore, at the time of extraction of the sleeve component 511 engaged with the engagement part 15 from the insertion hole 621, force applied from the jig 10 to the sleeve component 511 is uniform along the circumferential direction of the sleeve-component inner circumferential surface 521. Therefore, breaking of the sleeve component 511 during extraction of the sleeve component 511 can be suppressed.

When the number of the clearance grooves 31 formed on the engagement part 15 is a plural number being three or more, the position misalignment between the central axis of the engagement part 15 and the central axis of the sleeve-component inner circumferential surface 521 is further suppressed. When the number of the clearance grooves 31 formed on the engagement part 15 is an odd number equal to or larger than three, the position misalignment between the central axis of the engagement part 15 and the central axis of the sleeve-component inner circumferential surface 521 is suppressed more.

When the number of the clearance grooves 31 formed on the engagement part 15 is increased, the number of cutting edges per pitch of the thread on the engagement part 15 is increased, so that the number of times of cutting can be increased and the engagement groove can be reliably formed.

When the number of the clearance grooves 31 formed on the engagement part 15 is increased, "the length along the starts of the thread" of one continuous taper surface 21 sandwiched between cutting edges is shortened. As a result, the amount pressed by one continuous taper surface 21 sandwiched between cutting edges is reduced and damages on the inner wall of the insertion hole 621 provided on the panel 611 during insertion of the jig 10 into the sleeve component 511 can be suppressed.

(6-3. Characteristics and Effects of Inner Circumferential Surfaces of Clearance Grooves and Cutting Edges)

In the sleeve-component extracting jig according to the present embodiment, the cutting edges formed on the thread by the clearance grooves 31 can be formed to have a positive rake angle $\alpha$. When the rake angle $\alpha$ is increased, the sleeve-component inner circumferential surface 521 protruding in front of cutting edges in the moving direction as viewed from the cutting edges can be cut more reliably.

Particularly, when the cutting edges have a positive rake angle $\alpha$, chips of the sleeve component 511 produced in front of the cutting edges in the moving direction are removed from the front of the cutting edges in the moving direction along the inner circumferential surfaces of the clearance grooves 31 as compared to a case where the cutting edges have a negative rake angle $\alpha$. As a result, the chips are suppressed from being stuck between the thread and the engagement groove. Further, increase in the pressing amount against the sleeve-component inner circumferential surface 521, resulting from the chips stuck between the thread and the engagement groove is suppressed. Accordingly, damages on the inner wall of the insertion hole 621 provided on the panel 611 can be suppressed.

In the sleeve-component extracting jig according to the present embodiment, the inner circumferential surface of each of the clearance grooves 31 can be formed of a portion of a cylindrical surface. As illustrated in FIGS. 3A and 3B, when the central axes of the cylindrical surfaces forming the inner circumferential surfaces of the clearance grooves 31 are Q1, Q2, and Q3, respectively, the distances between the respective central axes Q1, Q2, and Q3 of the cylindrical surfaces and the central axis Q0 of the engagement part 15 in a plane perpendicular to the central axis Q0 of the engagement part 15 can be shorter than the distance between the taper surfaces 21 and the central axis Q0 of the engagement part 15. Because the inner circumferential surfaces of the clearance grooves 31 are respectively portions of the cylindrical surfaces, the rake angle $\alpha$ of the cutting edges can be set to a predetermined angle when the clearance grooves 31 are formed on the jig 10 using an existing cutting device or the like. The shape of the inner circumferential surfaces of the clearance grooves 31 can include different other variations.

(6-4. Characteristics and Effects of Thread)

In the sleeve-component extracting jig according to the present embodiment, the crests of the thread can be formed to have an angle equal to or lower than 60 degrees. The angle of the crests of the thread is the angle of an angle $P_5$ of the triangle "$P_3P_4P_5$" illustrated in FIG. 4. As the angle of the crests of the thread is smaller in a case where the height of the thread is constant, the area $S_0$ decreases and consequently "the pressing amount of the thread" decreases. Therefore, as the angle of the crests of the thread is smaller, damages on the inner wall of the insertion hole 621 provided on the panel 611 can be prevented more.

In the sleeve-component extracting jig according to the present embodiment, the number of starts of the thread formed on the engagement part 15 can be equal to the number of the clearance grooves 31. In a case where the number of starts of the thread formed on the engagement part 15 and the number of the clearance grooves 31 match, the symmetry about the central axis Q0 of the engagement part 15 is improved. As a result, engagement where the central axis of the engagement part 15 is located diagonally to the central axis of the sleeve component 511 is suppressed.

For example, when the number of starts of the thread is three in a structure in which three clearance grooves 31 are provided, 120-degree symmetry about the central axis Q0 of the engagement part 15 is rigorously realized. Therefore, the engagement part 15 is supported at three points on the sleeve component 511 and engagement where the central axis of the engagement part 15 is located diagonally to the central axis of the sleeve component 511 is suppressed.

(6-5. Characteristics and Effects of Guide Part)

In the sleeve-component extracting jig according to the present embodiment, the cylindrical guide part 17 can be formed integrally with the engagement part 15 at the leading end. The length of the radius of the guide part 17 can be equal to or larger than the length of the radius of the outer circumferential portion at the leading end of the engagement part 15 and smaller than the length of the inside radius of the sleeve-component inner circumferential surface 521.

By providing the guide part at the leading end of the engagement part 15, engagement where the central axis of the engagement part 15 is located diagonally to the central axis of the sleeve component 511 is suppressed at the time of insertion of the jig 10 into the sleeve component 511 and thus damages on the inner wall of the insertion hole 621 provided on the panel 611 can be suppressed.

Although the contents of the present invention have been described above by reference to the embodiment, the present invention is not limited to these descriptions, and it will be apparent to those skilled in the art that various modifications and improvements can be made. It should not be construed that the present invention is limited to the descriptions and the drawings that constitute a part of the present disclosure. On the basis of the present disclosure, various alternative embodiments, practical examples, and operating techniques will be apparent to those skilled in the art.

In is needless to mention that the present invention also includes various embodiments that are not described herein. Therefore, the technical scope of the present invention is to be defined only by the invention specifying matters according to the scope of claims appropriately obtained from the above descriptions.

REFERENCE SIGNS LIST

10 jig
11 wrench operation part

13 shaft part
15 engagement part
17 guide part
21 taper surface
31 clearance groove
511 sleeve component
521 sleeve-component inner circumferential surface
611 panel
621 insertion hole

What is claimed is:

1. A sleeve-component extracting jig comprising an engagement part that is to be inserted into a sleeve component press-fitted into a panel made of fiber-reinforced plastic to extract the sleeve component, wherein the engagement part has a helical thread engageable with an inner circumferential surface of the sleeve component, the thread being formed on an outer circumferential surface of a shaft body with a constant diameter, a taper surface configured by cutting off crests of the thread to lower a height of the thread toward a leading end of the engagement part, and a plurality of clearance grooves open at the leading end of the engagement part and arranged at equal angular intervals in a circumferential direction of the engagement part are formed in the engagement part, a length of a radius of the engagement part at an end position of the taper surface is a sum of a length obtained by multiplying a thickness of the sleeve component by a digging ratio and a length of an inside radius of the inner circumferential surface of the sleeve component, the digging ratio has a value in a range between 20% and 60%, a length of an outer circumferential portion of the thread per pitch, measured along a helical direction along a crest of the thread in a case where the clearance grooves are not provided, is L1, a length of an outer circumferential portion of the thread per pitch, measured along the helical direction along the crest of the thread in a case where the clearance grooves are provided, is L2, a ratio L2/L1 decreases as approaching the leading end of the engagement part for the thread located between the leading end of the engagement part and the end position of the taper surface, the ratio L2/L1 is equal to or larger than 0.5 entirely on the engagement part, and the clearance grooves each include a cylindrical surface and a central axis of the cylindrical surface is disposed radially inward of a radius of the taper surface.

2. The sleeve-component extracting jig according to claim 1, wherein the plurality of the clearance grooves includes three or more of the clearance grooves provided on the engagement part.

3. The sleeve-component extracting jig according to claim 2, wherein an odd number of the clearance grooves are provided on the engagement part.

4. The sleeve-component extracting jig according to claim 1, wherein cutting edges formed by the thread and the clearance grooves have a positive rake angle with respect to the inner circumferential surface of the sleeve component.

5. The sleeve-component extracting jig according to claim 1, wherein an inner circumferential surface of each of the clearance grooves is formed of a portion of a cylindrical surface, and a distance between a central axis of the cylindrical surface and a central axis of the engagement part in a plane perpendicular to the central axis of the engagement part is shorter than a distance between the taper surface and the central axis of the engagement part.

6. The sleeve-component extracting jig according to claim 1, wherein the crests of the thread can be formed to have an angle equal to or lower than 60 degrees.

7. The sleeve-component extracting jig according to claim 1, wherein a cylindrical guide part is formed integrally with the leading end of the engagement part, and a length of a radius of the guide part is equal to or larger than a length of a radius of an outer circumferential portion of the engagement part at the leading end and smaller than a length of an inside radius of the inner circumferential surface of the sleeve component.

8. The sleeve-component extracting jig according to claim 1, wherein the plurality of clearance grooves each include an opening in an outermost end surface of the sleeve-component extracting jig at the leading end of the engagement part, and each opening is open in a longitudinal direction of the engagement part.

* * * * *